US005788436A

United States Patent [19]

Lazar

[11] Patent Number: 5,788,436

[45] Date of Patent: Aug. 4, 1998

[54] METHOD FOR AND DEVICE USED IN PRODUCING A BOOK BINDING

[76] Inventor: Peter Lazar, Linneplatz 3, D-41466 Neuss, Germany

[21] Appl. No.: 385,132

[22] Filed: Feb. 7, 1995

[30] Foreign Application Priority Data

Feb. 8, 1994 [DE] Germany ..... 44 03 887.9

[51] Int. Cl.[6] ..... B42C 9/00

[52] U.S. Cl. ..... 412/1; 412/8; 412/6

[58] Field of Search ..... 412/1, 3, 4, 6, 412/8, 19, 22, 37, DIG. 900

[56] References Cited

U.S. PATENT DOCUMENTS

| | | | |
|---|---|---|---|
| 3,707,418 | 12/1972 | Bhagat | 412/37 |
| 4,367,061 | 1/1983 | Wiholm | 412/3 |
| 4,606,689 | 8/1986 | Wiholm | 412/3 |
| 4,718,969 | 1/1988 | Lazar | 156/500 |
| 4,968,203 | 11/1990 | Lazar | 412/8 X |
| 4,984,949 | 1/1991 | Reckziegel | 412/8 |
| 5,028,193 | 7/1991 | Misicka | 412/8 X |

FOREIGN PATENT DOCUMENTS

| | | |
|---|---|---|
| 0176844 | 9/1985 | European Pat. Off. . |
| 2237583 | 7/1972 | Germany . |
| 2528225 | 6/1975 | Germany . |
| 2611242 | 3/1976 | Germany . |
| 2743685 | 9/1977 | Germany . |
| 2937171 | 9/1979 | Germany . |
| 3010642 | 3/1980 | Germany . |
| 3047230 | 12/1980 | Germany . |
| 3435704 | 9/1984 | Germany . |
| 3622542 | 7/1986 | Germany . |

*Primary Examiner*—Willmon Fridie, Jr.
*Attorney, Agent, or Firm*—Joseph W. Berenato, III

[57] ABSTRACT

Method for producing a book binding that is comprised of at least one book binding sheet, having at least one book binding cover that is connected to a binding spine, in which a strip of molten adhesive is applied on the inner side of the binding sheet at the point that is to form the spine. Before it is applied, the molten adhesive is heated so that the adhesive is in a plastic state. In order to ensure that the molten adhesive is applied securely in the desired shape and with little cost, the molten adhesive (10, 41) is reshaped after being at least partially applied to the binding sheet (11, 40).

24 Claims, 4 Drawing Sheets

METHOD FOR AND DEVICE USED IN PRODUCING A BOOK BINDING

SPECIFICATION

Figure 1:
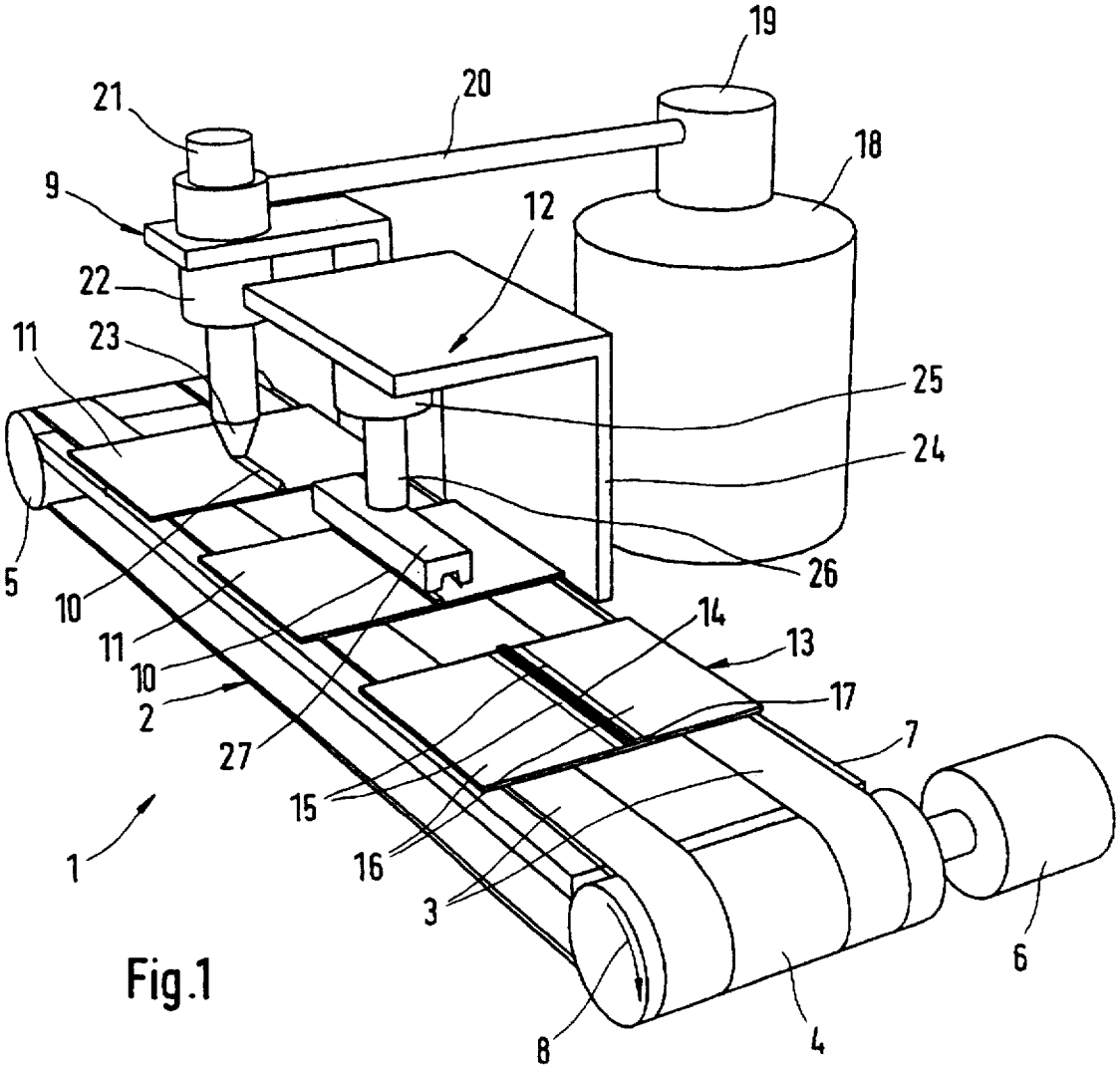
Figure 2:
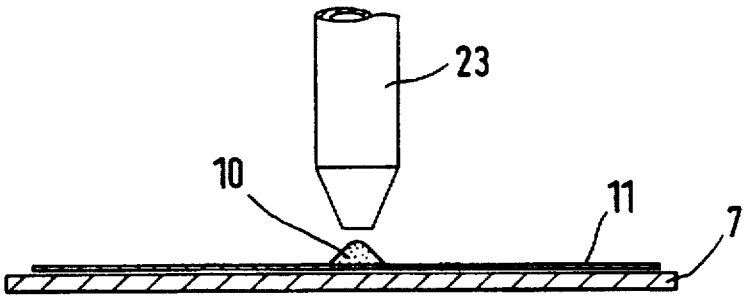

The invention involves a method for producing a book binding that is comprised of at least one book binding sheet having at least one book binding cover that is connected to a binding spine, in which a strip of molten adhesive is applied to the inner side of the binding sheet at the point that will form the book spine, after being brought via heating to at least a plastic state. The invention further involves a device used in implementing this method, comprising at least one heating device for liquefying the molten adhesive and one feeder device for applying the molten adhesive to the binding sheet.

Book bindings of the above-mentioned type are usually comprised of a book spine with binding covers on the front and the back that are connected to the spine via joints. They are most often made of cardboard, although the binding cover on the front may be made of a transparent plastic. Bindings of this type are specified, for example, in DE-PS 25 28 225 and DE-OS 22 37 583.

A strip of molten adhesive is applied to the inner side of the book spine. Such molten adhesives are solid at room temperature, but become plastic at temperatures of between 70° C. and 190° C.—depending upon their composition. When it has cooled the molten adhesive again becomes solid, a process which may be repeated several times.

These properties of the molten adhesive are used to advantage in binding paper pages into a book binding. In this case, the longitudinal edges of the paper pages are placed inside the binding cover, which is set upright on its spine, so that their longitudinal edges lie on the molten adhesive, which is still solid. The binding cover is then placed into a binding apparatus, such as is specified in DE-OS 27 43 685. In this device, the spine of the cover is positioned over a heating plate which heats the molten adhesive through the book spine, bringing it to a plastic state. When the molten adhesive has become plastic the pages sink into the molten adhesive, their edges becoming enclosed by the molten adhesive. When the adhesive has cooled, the pages are firmly bonded to the book spine.

In DE-OS 29 37 171, a similar method for producing book bindings is revealed in which the liquefied molten adhesive is applied directly to the book spine via an extrusion die. The disadvantage of this is that, due to the surface tension of liquid molten adhesive, the molten adhesive that is applied always assumes a tracked shape, regardless of the shape of the extrusion die, thus the strip of molten adhesive is always thicker at its center than at its sides. The result is that in the subsequent binding process the outer pages, which absorb the greatest amount of stress, are held in a layer of molten adhesive that is too thin, thus they can too easily become loosened. In addition, the pages may slip to the outside or may become irregularly slanted prior to the heating process, which is also undesirable. Nor can the precise positioning of the molten adhesive, which is imperative for a perfect binding, be achieved to the necessary degree. Finally, this process does not work when the application of the molten adhesive is very narrow, with widths of 1 mm or less.

In a method specified in EP-OS 0 176 844, the production of a precisely positioned strip of molten adhesive that is even over its length, its width, and its depth is specified. In this process the molten adhesive is heated and is placed in a mold, and the book spine is pressed into this mold. The disadvantage of this method is that the molten adhesive that is placed in the mold often adheres better to the mold than to the book spine that is subsequently pressed into the mold. In a continuous production process this is quite disruptive, since the continuous production process must then be interrupted in order to clean the molten adhesive residue off of the mold.

Up to now, in order to avoid these disadvantages, the molten adhesive has been applied in the form of a solid strip to the book spine, to which it is attached via either pressure and heat or an additional adhesive. This can be accomplished either by hand or via a process such as is specified in DE-OS 30 10 642. The disadvantage of this process is that it requires considerable production costs. This is due first to the fact that the raw material used for the molten adhesive, which is available either in rolls or in sheets, is more expensive than the raw material required for liquid application. And second, additional expenses are incurred in the prior shaping of the molten adhesive into the desired strip form.

The object of the invention is to provide a method for producing a book binding in which a strip of molten adhesive may be applied in the desired shape, at low cost, and without disruption. A further object is to develop a device that is suitable for implementing this method.

The first object is attained in accordance with the invention in that the strip of molten adhesive is shaped, preferably via a forming tool, after being at least partially applied to the binding sheet.

The method specified in the invention is based upon the premise that the liquid or plastic molten adhesive forms an intimate bond with the binding sheet immediately after its application, before it begins to cool and to solidify. In this way, a firm bond between the strip of molten adhesive and the book spine is guaranteed. On the other side, the exposed surface of the strip of molten adhesive cools, forming a thin film, with the adhesive strength of the molten adhesive decreasing as its cools. Thus, in the subsequent reshaping of the strip of molten adhesive via a forming tool, which operates on the exposed surface, the molten adhesive will not adhere to the forming tool. In this way this method will allow the creation of practically any desired profile with the appropriate design of the forming tool.

The reshaping of the molten adhesive applied to the binding sheet, in accordance with the invention, can be implemented either after the complete application of the strip of molten adhesive or coincident with the application of a portion of the molten adhesive. What is essential in the reshaping of the strip of molten adhesive is that the plastic molten adhesive be applied to the binding sheet prior to the reshaping process.

The invention provides for the forming tool to be moved during or after the reshaping process in a longitudinal and/or transverse direction along the strip of molten adhesive. This is of particular advantage in cases when the strip of molten adhesive has been applied unevenly along its longitudinal axis. The longitudinal movement of the forming tool allows the transportation of molten adhesive from places where there is an excess of adhesive to places with too little molten adhesive, thus ensuring an even application of molten adhesive.

The invention provides for the molten adhesive to be heated, prior to its application to the binding sheet, to a temperature that is higher than its setting temperature, but lower than the temperature at which it becomes completely liquefied. This is based upon the discovery, which is part of the invention, that it is not necessary to apply the molten adhesive in such a liquid state that it will distribute itself over the binding sheet. Instead, the reshaping of the strip of molten adhesive using a forming tool creates an even distribution.

The invention further provides that the strip of molten adhesive that is applied to the binding sheet is cooled on its exposed surface prior to reshaping until a thin layer of solidified molten adhesive has formed. This ensures that the molten adhesive will have lost its adhesive properties on the surface that is to come into contact with the forming tool, thus permitting the subsequent reshaping without the undesirable adhesion of the molten adhesive to the forming tool. This further ensures that the reshaped strip of molten adhesive will not again assume a tracked shape due to surface tension on the exposed surface.

A device suited for implementing the above-described process is characterized by a forming device for reshaping the strip of molten adhesive that is applied to the binding sheet, whereby the forming device may comprise a forming tool and a pressing device for applying pressure to the forming tool.

In one embodiment of the device specified in the invention, the forming tool is delimited by a stamping cover and at least two side panels, and is left exposed along its lower longitudinal side and at its two ends. It is also of particular advantage, however, for the forming tool to have end panels. In this way a complete shape can be achieved via the application of pressure to the forming tool, which produces a particularly precise positioning and reshaping of the strip of molten adhesive.

For purposes of expediency, the side panels of the forming tool are designed as folding edges for the purpose of stamping joints into the binding sheet, simultaneously with the reshaping of the strip of molten adhesive. In this way the reshaping of the strip of molten adhesive and the stamping of the joints into the book cover can be implemented in a single pass.

The invention provides for the pressing device to comprise a supporting surface opposite the exposed longitudinal side of the forming tool, which contains grooves that lie opposite the lower edges of the side panels of the forming tool. This serves to improve the seal between the forming tool and the work surface. A flexible design for the supporting surface serves this same purpose.

The molten adhesive may be given any desired profile by designing the forming tool accordingly. It is particularly advantageous for the forming tool to be more shallow along its longitudinal center axis than at its edges. It is also particularly advantageous for its stamping cover to be curved downward toward its longitudinal center axis, as this will create a trough-shaped impression in the cross-section of the strip of molten adhesive, on the side on which the edges of the pages will be placed for binding. In this way, the pages will be pushed toward the center prior to the plastification of the strip of molten adhesive. In addition, the strip of molten adhesive will be thickest along its longitudinal edges, where the pages will absorb the greatest amount of stress, which will improve the hold on the pages. Finally, this permits the option of working with thinner strips of molten adhesive, thus saving on molten adhesive.

A further device for implementing the method for producing a book binding as specified in the invention is characterized by a forming tool that is equipped with at least one rotating roller and a forward feed device for the forming tool. A particular advantage of a device of this type it that the application of the molten adhesive to the binding sheet and the subsequent reshaping can be implemented with one series of forward feed movements, while permitting the precise positioning and reshaping of the strip of molten adhesive. This device is also particularly advantageous in terms of the time required to mass-produce book bindings.

This device is further designed such that the forming tool comprises a roller having one groove that extends around its entire circumference for the purpose of reshaping the strip of molten adhesive. A particular advantage of this type of roller is that only a relatively small portion of the circumference of the roller comes into contact at any one time with the strip of molten adhesive in the reshaping of the strip of molten adhesive. The roller rotates forward with the forming tool, which is moved over the strip of molten adhesive, and the surface of the roller that has come into contact with the strip of molten adhesive in the reshaping process cools in the surrounding air. Thus the roller always remains at a low temperature during the reshaping of the strip of molten adhesive, which reduces the tendency of the molten adhesive to adhere to the roller. In this way disruptions in the production process can be avoided and the throughput of the device specified in the invention is increased.

If, as is provided for in this embodiment of the invention, the groove is greater in diameter along its center axis than at its edges, it is ensured that the strip of molten adhesive will be trough-shaped in its cross-section, on the side upon which the edges of the pages will stand during the binding process. This will cause the pages to be directed toward the center and held together. In addition, the application of molten adhesive will be thickest along the edges of the longitudinal sides, where the pages will absorb particularly high amounts of stress, which will improve the hold on the pages. Finally, this permits the option of working with thinner layers of molten adhesive, thus saving on molten adhesive.

Finally, it is advantageous for the roller to comprise a tooling ring on each side of the groove for the purpose of stamping joints into the binding cover. In a roller design of this type the steps of reshaping the strip of molten adhesive and stamping in the joints can be combined, which further increases the throughput of the device specified in the invention.

In an alternative embodiment of the invention, the forming tool comprises two rollers that are also mounted on shafts whose extensions coincide. With this type of roller the forming tool can be directed with particular precision in terms of the forming tool's supporting surface, which results in the desired reshaping of the strip of molten adhesive.

If, in a further embodiment of the invention, the rollers each contain a tooling ring for the purpose of stamping a joint into the binding sheet, the result will be a particularly accurate folding of the binding cover.

The design of the device specified in the invention comprises a groove, positioned between the rollers, that is exposed at least on the lower side and at its two ends, for the purpose of reshaping the strip of molten adhesive. In this design of the forming tool, the strip of molten adhesive is shaped by a stationary component of the forming tool. In contrast to a movable forming tool component for the reshaping of the strip of molten adhesive, this is advantageous because movable forming tool components can become so dirtied from the intensive contact with the molten adhesive that their movement becomes limited. In the design of the forming tool without movable components this cannot occur, which increases the reliability of the device specified in the invention.

Finally, in the devices specified in the invention the forming tool and the feeder device are positioned along the conveying path of a conveyor belt. This positioning of the forming tool and the feeder device allows the production of the book bindings to become fully automatic and to take place at a very high speed. This is specifically the case when the book bindings that are to be supplied with a strip of molten adhesive are automatically placed upon the conveyor belt. This increases the throughput of the devices specified in the invention.

Figure 3:
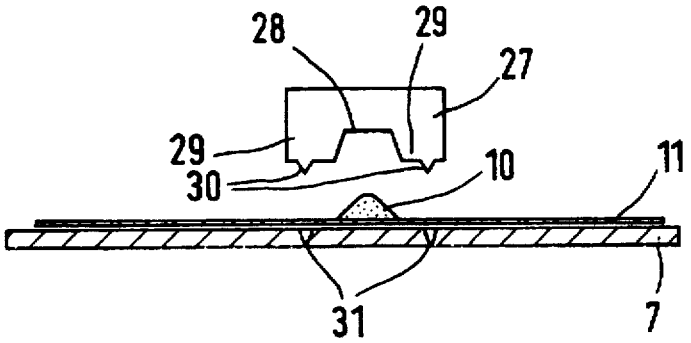
Figure 4:
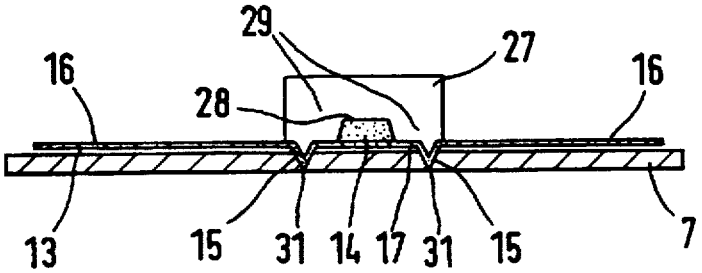
Figure 5:
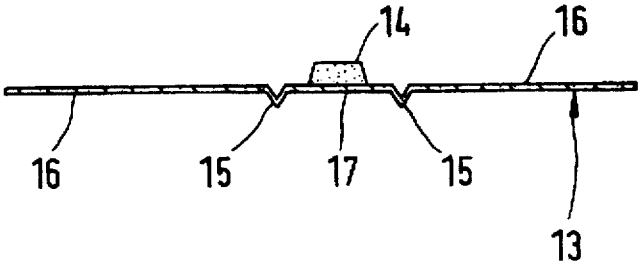
Figure 6:
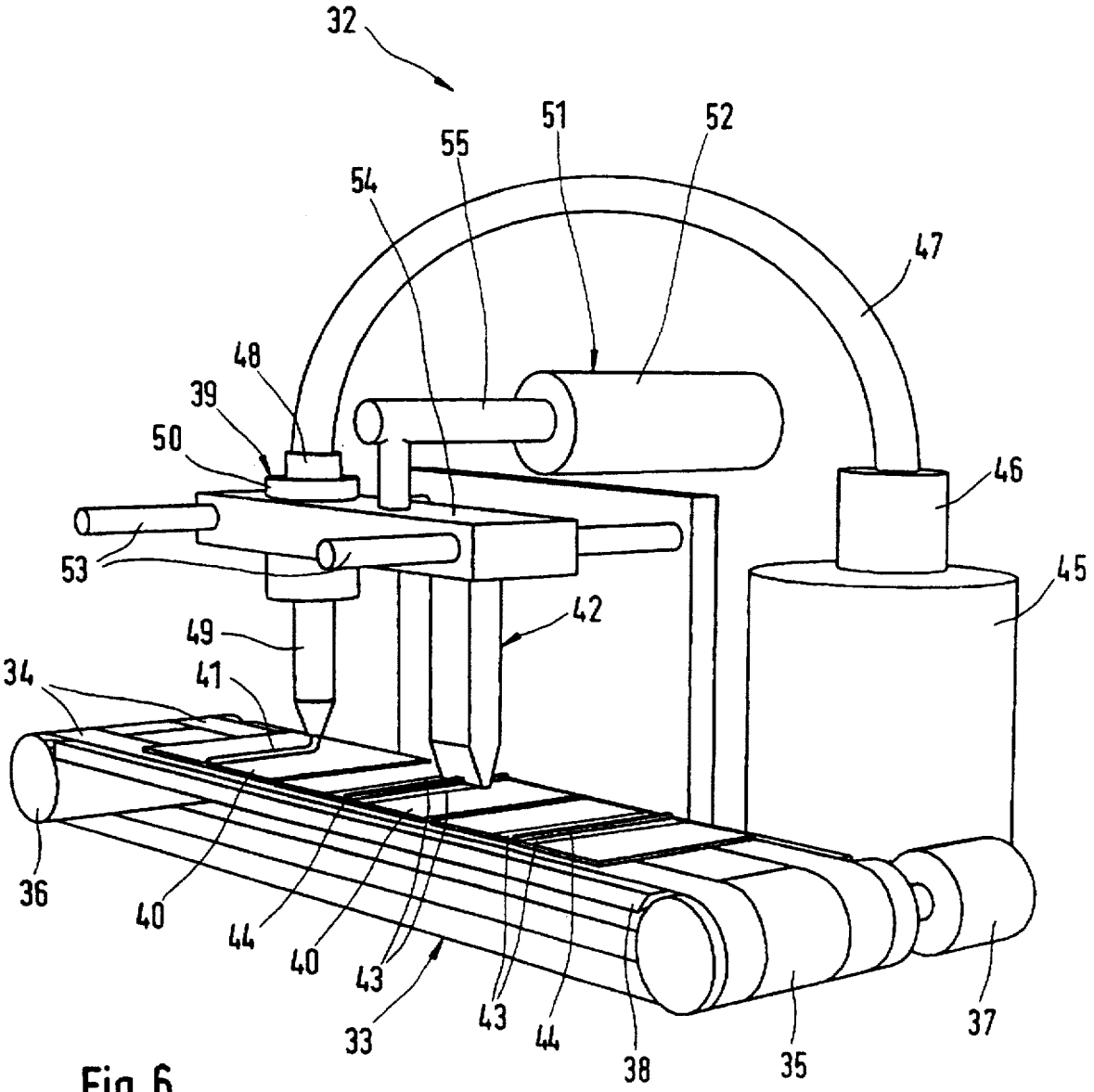
Figure 7:
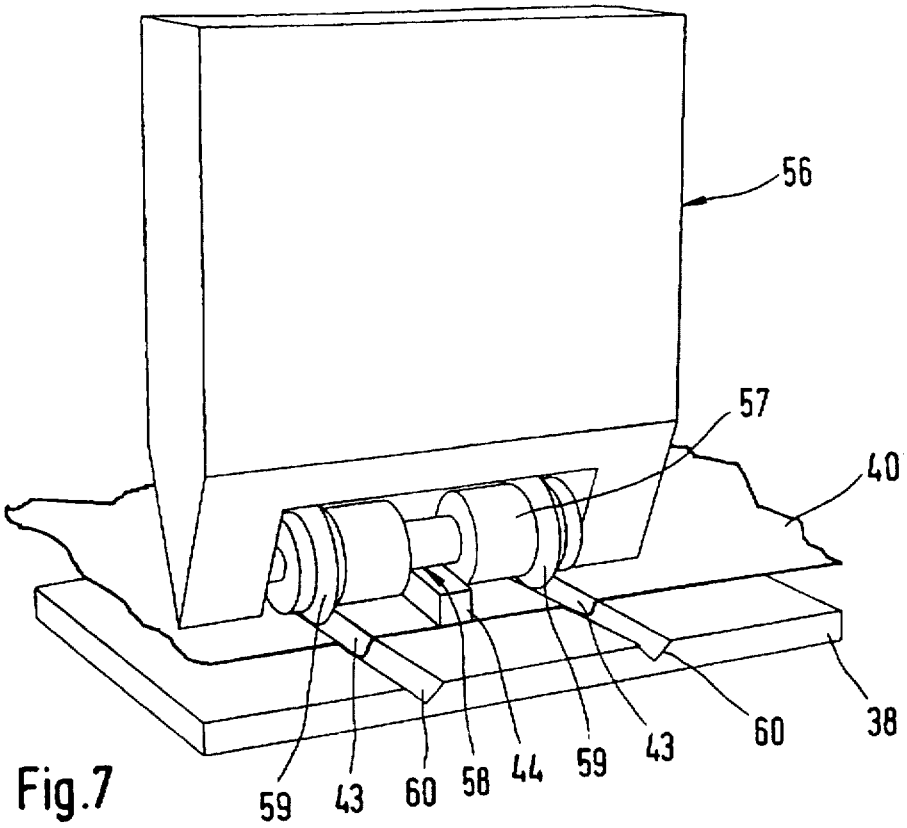
Figure 8:
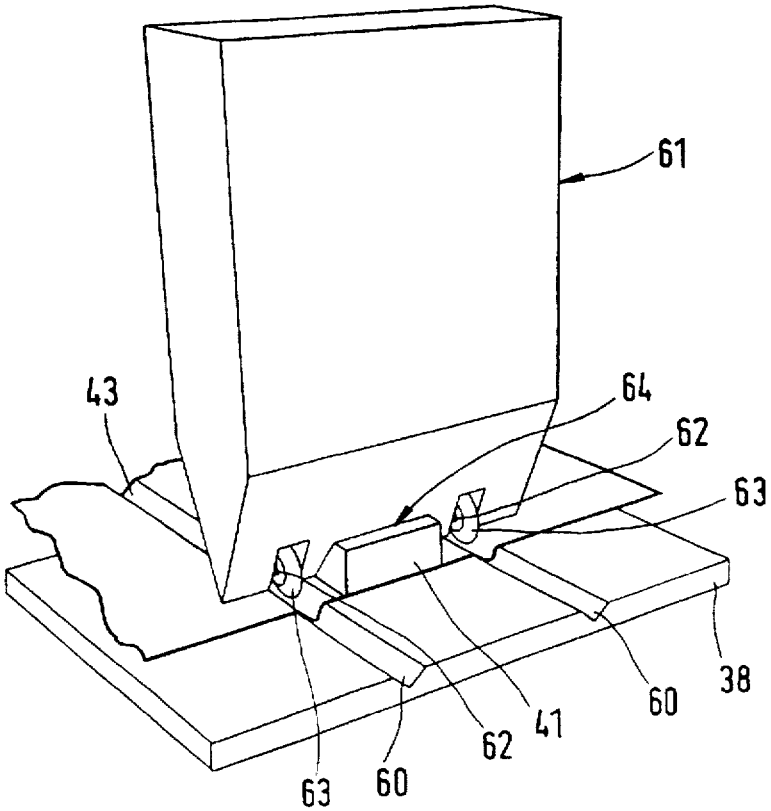

In the diagram, the invention is illustrated with the help of exemplary embodiments. These show:

FIG. (1) a perspective view of a device for the production of book bindings;

FIG. (2) a cross-section of a binding sheet that has been supplied with molten adhesive using the device in accordance with FIG. 1; a molten adhesive die is positioned above the binding sheet;

FIG. (3) a cross-section of the binding sheet in accordance with FIG. 1 with a forming tool positioned above it;

FIG. (4) a cross-section of the binding sheet in accordance with FIG. 3 with a forming tool pressed into the strip of molten adhesive;

FIG. (5) a cross-section of a completed book binding;

FIG. (6) a perspective view of another device for the production of book bindings;

FIG. (7) a forming tool in the device in accordance with FIG. 6; and

FIG. (8) a further forming tool in the device in accordance with FIG. (6).

The device (1) perspectively illustrated in FIG. (1) contains a conveyor belt (2) having two conveyor straps (3) which are laid over a driving roller (4) and a deflecting roller (5). The driving roller (4), which is driven by an electric motor (6), and the deflecting roller (5) are positioned such that the straight sections of the conveyor straps (3) that extend between the rollers run horizontally. The straight sections of the conveyor straps (3) that are on top are supported by a flat supporting plate (7). When the electric motor (6) is engaged, the driving roller (4) rotates clockwise in the illustrated view, as is indicated by the arrow (8) showing the direction of rotation.

A feeder device (9), for the purpose of applying a strip of molten adhesive (1) to a binding sheet (11), and a forming device (12), for the purpose of reshaping the applied strip of molten adhesive (10) and stamping joints into the binding sheet (11), are positioned, heading in the rotating direction of the conveyor belt (2), from the starting point along the belt up to its end. Finally, a completed book binding (13), which contains a strip of molten adhesive (14) in the desired shape, and which also contains joints (15) that separate the two binding covers (16) from the book spine (17), can be removed from the conveyor belt (2).

The feeder device (9) that is used to apply the strip of molten adhesive (10) to the binding sheet (11) has a thermostatically regulated, heated container (18) which holds the liquefied molten adhesive. The liquefied molten adhesive is fed to a piston dosing device (21) via a pump (19) through a line (20); the dosing device is kept at a temperature that is high enough to ensure that the thermoplastic molten adhesive will emerge in a plastic state through a molten adhesive die (23), as a track-shaped strip of molten adhesive (10).

The piston dosing device (21) and the electric motor (6) are connected to one another such that the piston dosing device (21) approaches the conveyor belt (2) at the start of the conveyance process, and advances the binding sheet (11) at a constant speed under the molten adhesive die (23), ensuring that the strip of molten adhesive (10) will have an even lateral section. With the regular movement of the piston dosing device (21) and the conveyor belt (2) the strip of molten adhesive (10) begins on one side edge of the binding sheet (11) and ends on the opposite edge.

Following the application of the strip of molten adhesive (10), the binding sheet (11) is transported via the conveyor belt (2) underneath the forming device (12). The forming device (12) contains a press (24), which extends above and perpendicular to the conveyor belt (2). A hydraulic piston press (25) is positioned on the underside of a protruding side of the press (24), and a forming tool (27), whose length is equal to the width of the binding sheet (11), is attached to the piston (26). The piston press (25) presses the forming tool (27) onto the binding sheet (11), and shapes the binding sheet (11) with the strip of molten adhesive (10) that has been applied to it, into a binding cover (13). The cover is advanced, after the forming tool (27) has been lifted, by the movement of the conveyor belt (2), and can then be removed from the conveyor belt (2).

FIG. (2) shows a cross-section of the binding sheet (11), positioned at the feeder device (9), and of the supporting plate (7) with a view of the feeder device (9), of which, in the figure shown, only the molten adhesive die (23) is visible. To clarify the illustration, in this view the conveyor straps (3) on which the binding sheet (11) will be advanced, have been omitted. The track-shaped strip of molten adhesive (10) is applied to the binding sheet (11).

In FIG. (3), the binding sheet (11) with the applied strip of molten adhesive (10) is depicted underneath the forming device (12), of which only the forming tool (27) is shown here. To clarify the illustration, only the supporting plate (7) of the conveyor belt (20) is shown here, while the conveyor straps (3) have been omitted. As can be clearly seen from this view, the forming tool (27) is delimited by a stamping cover (28) and two side panels (29), on whose lower edges are two folding edges (30). The binding sheet (11) is positioned beneath the forming tool (27). And the strip of molten adhesive (10) lies in the center between the side panels (29) and between the grooves (31) that are in the supporting plate (7) and opposite the folding edges (30).

FIG. (4) shows the book binding (13) that has been created by reshaping the binding sheet (11) and the strip of molten adhesive (10), in which the strip of molten adhesive (14) is trapezoidal in its cross-section. The forming tool (27) is still resting on the strip of molten adhesive (14). As can be clearly seen, the strip of molten adhesive fills up the entire hollow space that is created by the stamping cover (28), the side panels (29), and the book spine (17). The folding edges (30) stamp the binding sheet (11) into the grooves (31) thus forming the joints (15).

FIG. (5), finally, shows the completed book binding (13), which is comprised primarily of the trapezoidal strip of molten adhesive (14) on the book spine (17), and the two binding covers (16), which are separated from the spine (17) by joints (15).

FIG. (6) shows a further device (32) for producing a book binding in accordance with the method specified in the invention. The device (32) contains a conveyor belt (33) having conveyor straps (34) which are advanced over a driving roller (35) and a deflecting roller (36). The driving roller (35) is flanged onto an electric motor (37). Further, the conveyor belt (33) comprises a supporting plate (38), which supports the upper sections of the conveyor straps (34) that run between the driving roller (35) and the deflecting roller (36).

A feeder device (39), which supplies a binding sheet (40) with a track-shaped strip of molten adhesive (41), and a forming device (42) are positioned along the transporting path of the conveyor belt (33); these stamp joints (43) into the binding sheet (40) and reshape the strip of molten adhesive (41) into a trapezoidal strip of molten adhesive (44).

The feeder device (39) comprises a heated container (45), which contains liquid thermoplastic molten adhesive, and a pump (46), which feeds the liquid molten adhesive, via a line (47), to a dosing device (48). Directly attached to the dosing device (48) is a molten adhesive die (49), which is held via an electric heating element (50) at a temperature that is high enough to keep the molten adhesive that emerges from the molten adhesive die (49) at least ductile. The feeder device (39) is integrated into a forward feed device (51), which is comprised primarily of a hydraulic piston drive (52) and a holding device (54) that is positioned on two linear leads (53). The holding device (54) is connected to a piston (55) of the piston drive (52). Further, the piston drive (52) is connected to the feeder device (39) such that molten adhesive will emerge from the molten adhesive die (49) at precisely the point at which the forward feed device (51) initiates the advance of the holding device (54). Finally, the forming device (52) is also integrated into the forward feed device (51). The forming device (52) is, seen longitudinally along the conveyor belt (33), positioned a distance from the feeder device (39) that is precisely equal to the length of two strips of molten adhesive (41) on adjacent book binding sheets (40). This will ensure that with the forward-feed movement of the forward feed device (51) the strip of molten adhesive (41) will be applied to a binding sheet (40), while at the same time the strip of molten adhesive (44) and the joints (43) will be formed on the binding sheet that is next in line along the conveyor belt (33).

FIG. (7) shows a forming tool (56) as a detail of the forming device (42). The forming tool (56) comprises on its lower side a rotating roller (57). The roller (57) is equipped with a groove (58) in its center that extends around its entire circumference, and with tooling rings (59) on both sides of the groove, also around its entire circumference. In the supporting plate (38) are two grooves (60), positioned such that the movement of the forward feed device (51) causes the tooling rings (59) to coincide with these grooves (60). Thus the binding sheet (40) that is placed between the forming tool (56) and the supporting plate (38) is supplied with two joints (43). Simultaneously, the strip of molten adhesive (41) is reshaped by the groove (58) via the rotation of the roller (57) into a strip of molten adhesive (44) that is trapezoidal in its cross-section.

FIG. (8) shows a further forming tool (61), which contains two rotating rollers (62) on its underside. The rollers (62) are each equipped with a tooling ring (63) around their entire circumference. With the forward feed of the forming tool (61) caused by the forward feed device (51), the tooling rings (63) roll into the grooves (60) of the supporting plate (38). Thus when the binding sheet (40) is placed between the forming tool (61) and the supporting plate (38), joints (43) are stamped into it. Between the rollers (62) is a trapezoidal groove (64) for the reshaping of the strip of molten adhesive (41).

I claim:

1. A device for producing a book binding that includes at least one book binding sheet that has at least one book binding cover connected to a binding spine, the device implementing a method comprising the steps of:

applying a strip of molten adhesive in at least a plastic state to the inner side of the binding sheet at a point that is to form the binding spine; and reshaping the strip of molten adhesive (10, 41) after the strip has been at least partially applied to the binding sheet (11, 40); and the device including at least one heating device (22) for liquifiying the molten adhesive and one feeder device (9) for applying the molten adhesive to the book binding sheet (11), and a forming device (25, 27) for reshaping the strip of molten adhesive (10, 41) that is applied to the book binding sheet (11).

2. Method in accordance with claim 1, characterized in that the strip of molten adhesive (10, 41) is reshaped using a forming tool (27, 56, 61).

3. Method in accordance with claim 2, characterized in that the forming tool (27, 56, 61) is moved during the reshaping process in a longitudinal direction, relative to a binding sheet conveying direction, along the strip of molten adhesive (10, 41).

4. Method in accordance with claim 1, characterized in that prior to its application to the book binding sheet, the molten adhesive is heated to a temperature that is higher than its setting temperature but lower than the temperature at which it becomes completely liquefied.

5. Method in accordance with claim 1, characterized in that the exposed surface of the strip of molten adhesive that is applied to the book binding sheet is cooled prior to the reshaping process, to the point at which a layer of solidified molten adhesive forms.

6. Device in accordance with claim 1, characterized in that the forming device comprises a forming tool (27) and a pressing device (25) which applies pressure to the forming tool (27).

7. Device in accordance with claim 6, characterized by a forming tool that is delimited by a stamping cover (28) and at least two side panels (29), and is left exposed along its lower longitudinal side and at its two end panels.

8. Device in accordance with claim 7, characterized in that the forming tool comprises end panels at its ends.

9. Device in accordance with claim 7, characterized in that the side panels (29) are designed as folding edges (30) for the purpose of stamping joints (15) into the book binding sheet (11) during the process of reshaping the strip (10).

10. Device in accordance with claim 7, characterized in that the pressing device (25) comprises a supporting surface (7) that lies opposite the exposed longitudinal side of the forming tool (27) and that contains grooves (31) that are positioned opposite the lower edges of the side panels (29).

11. Device in accordance with claim 7, characterized in that the pressing device comprises a flexible supporting surface that lies opposite the exposed longitudinal side of the forming tool.

12. Device in accordance with claim 7, characterized in that the forming tool has a greater clearance along its longitudinal center axis than at its edges.

13. Device for implementing the method in accordance with claim 3, characterized by a forming tool that is equipped with at least one rotating roller (57, 62), and by a forward feed device (51) for the forming tool (56, 61).

14. Device in accordance with claim 13, characterized in that the forming tool (56) contains a roller (57).

15. Device in accordance with claim 14, characterized in that the roller contains a groove (58) that extends around its entire circumference for the purpose of reshaping the strip (41).

16. Device in accordance with claim 15, characterized in that the diameter of the groove is greater along its center line than at its edges.

17. Device in accordance with claim 16, characterized in that the roller (57) comprises a tooling ring (59) that extends around its entire circumference on each side of the groove (58), for the purpose of stamping joints (43) into the book binding sheet (40).

18. Device in accordance with claim 13, characterized in that the forming tool (61) comprises at least two rollers (62).

19. Device in accordance with claim 18, characterized in that the rollers (62) are mounted on shafts whose extensions coincide.

20. Device in accordance with claim 18, characterized in that each of the rollers (62) comprises a rotating tooling ring (63) which extends around its entire circumference and which stamps a joint (43) into the book binding sheet (49).

21. Device in accordance with claim 18, characterized in that at least one groove (64) that is exposed on its lower side and at its two ends is positioned between the rollers (62) for the purpose of reshaping the strip of molten adhesive (41).

22. Device in accordance with claim 6, characterized in that the forming tool (27, 56, 61) and the feeder device (9, 39) are positioned along the conveying path of a conveyor belt (2, 33).

23. Method in accordance with claim 2, characterized in that the forming tool is moved during the reshaping process in a transverse direction, relative to a binding sheet conveying direction, along the strip of molten adhesive.

24. Method in accordance with claim 2, characterized in that the forming tool is moved following the reshaping process in a transverse direction, relative to a binding sheet conveying direction, along the strip of molten adhesive.

* * * * *